US006192611B1

(12) United States Patent
Molla

(10) Patent No.: US 6,192,611 B1
(45) Date of Patent: Feb. 27, 2001

(54) BANNER SUPPORT ASSEMBLY

(75) Inventor: Patrick Molla, Wendover (CA)

(73) Assignee: Bungee Banner Inc., Onatario (CA)

( * ) Notice: Subject to any disclaimer, the term of this patent is extended or adjusted under 35 U.S.C. 154(b) by 0 days.

(21) Appl. No.: 09/122,360

(22) Filed: Jul. 24, 1998

(51) Int. Cl.[7] ..... G09F 17/00

(52) U.S. Cl. ..... 40/604; 40/603; 248/201; 248/613; 160/378

(58) Field of Search ..... 40/604, 603, 607; 248/218.4, 201, 613; 160/376, 378

(56) References Cited

U.S. PATENT DOCUMENTS

| | | | | |
|---|---|---|---|---|
| 934,059 | * | 9/1909 | Ferguson | 160/376 |
| 1,487,970 | * | 3/1924 | Mushall | 160/376 |
| 1,674,565 | * | 6/1928 | Peterson | 40/611 |
| 2,470,318 | * | 5/1949 | Nadelson | 160/329 |
| 3,589,048 | | 6/1971 | Mollet et al. . | |
| 3,675,356 | | 7/1972 | Gilmoure . | |
| 3,824,724 | | 7/1974 | Miller et al. . | |
| 4,095,360 | | 6/1978 | Dinan et al. . | |
| 4,459,773 | | 7/1984 | Sandlin et al. . | |
| 4,548,377 | | 10/1985 | Huel . | |
| 4,880,195 | | 11/1989 | Lepley . | |
| 4,890,403 | | 1/1990 | Dinan . | |
| 5,172,505 | | 12/1992 | Borsella . | |
| 5,212,898 | | 5/1993 | Dinan et al. . | |
| 5,374,024 | | 12/1994 | Williams . | |
| 5,388,794 | | 2/1995 | Wolff . | |
| 5,428,913 | | 7/1995 | Hillstrom . | |
| 5,704,188 | | 1/1998 | Coulis . | |

FOREIGN PATENT DOCUMENTS

| | | | | |
|---|---|---|---|---|
| 14488 | * | 10/1934 | (AU) | 160/376 |

* cited by examiner

*Primary Examiner*—Cassandra H. Davis
(74) *Attorney, Agent, or Firm*—Greer, Burns & Crain, Ltd.

(57) ABSTRACT

A banner support assembly adapted to be mounted to an upstanding post including a pair of horizontally extending arms fixed in spaced relation to the post and first and second housing members adapted to receive an elongated banner's first and second slidingly engagable members. First and second housing members are adjustably secured to the extending arms through apertures whereby the banner is held taut in variable conditions.

14 Claims, 4 Drawing Sheets

BANNER SUPPORT ASSEMBLY

FIELD OF THE INVENTION

This invention relates to vertically mounted banners and more particularly to a banner support assembly adapted to be mounted on a supporting member for purposes of mounting decorative and advertising banners.

BACKGROUND OF THE INVENTION

Display devices useful for mounting temporary advertising messages outdoors where the message is readily noticed by people are nowadays common place. Because of the outdoor location of such advertising displays, they must be resistant to weather or protected from the effects of weather. As the wind loads, heat and cold continuously apply and then relax loads to the banner, the banner supporting structure, as well as the banner per se, is stressed and then relaxed on a daily basis. Often, fasteners or other similar means will be loosened by the repeated loads applied to the banner supporting structure by the changes in weather to cause the supporting structure to become loosened and potentially disengaged from the upstanding pole or other such supporting structures.

Current mounting techniques for vertical banners involve mounting such banners with the top horizontal edge of the banner as well as the bottom horizontal edge each having a hem running the width of the banner and thereby allowing a banner arm assembly to be inserted into the sleeve created by the hem. This type of mounting may be of permanent nature i.e. a steel banner arm assembly being welded at 90° on the upstanding post. The banner arm assembly may also possibly be of a removable nature with a fiberglass rod or steel tube inserted into a female socket.

Two of the mostly used vertical banner mounting systems use brackets with fiberglass rod banner arms and brackets with steel tube banner arms. The fiberglass arms are often preferred since they offer more flexibility, thereby permitting a limited cushioning of wind gusts although not offering enough flexibility to spill off high wind forces exerted against the banner. High winds can create forces in excess of 400 pounds per banner range, and without the capability of the banner being able to tip with and deflect the wind, these forces are directly transferred to the banner hems, arms, bracket bases and to the upstanding post. In such instances, wind gusts often result in tearing and damage to the banner.

It has been proposed that the destructive effect of wind gusts on banners be reduced by mounting fiberglass banner arms in a base plate held into a bracket base by means of springs and this might prove sufficient in situation of winds that are not unduly great.

All known techniques work in a way where they merely react to the conditions which makes it more reactive rather than proactive. Therefore, a need exists for the provision of a reliable banner support assembly which makes mounting the banners onto supporting members easy and time efficient and yet provides for the requisite durability and reliability in order to maintain the banner adequately supported and taut on the supporting member, thereby ensuring premium appearance of the message.

SUMMARY OF THE INVENTION

The present invention overcomes the above shortcomings.

It is an object of the present invention to provide a new and improved banner support assembly making mounting of banners on upstanding posts easy and efficient.

It is another object of the present invention to provide for a durable and reliable banner support assembly thereby ensuring premium appearance of the banner.

It will be appreciated from the following detailed description of the invention that the new and improved banner support assembly provides for flexibility to allow wind loads applied to the erected banner to spill before any over stressing of the banner support assembly occurs.

It is a further object of the present invention to provide a banner support assembly so reliable that a mounted banner will remain taut and will not become disengaged therefrom due to repeated loadings by wind and other weather elements acting on the banner supported by the banner support assembly.

It is yet a further object of the present invention to provide for an adapted banner construction for use in combination with the banner support assembly.

In accordance with another object of the present invention there is provided a banner support assembly adapted to be mounted on a supporting member for purposes of engaging and holding taut an elongated banner, said banner support assembly comprising a) first and second extending arms each being mounted in spaced relation onto said supporting member; b) first and second housing members adapted to receive corresponding first and second banner extremities which are secured therein; c) multiple rod members secured to first and second housing members and positioned through apertures in the first and second extending arms; d) attachment means correspondingly working in combination with the rod members thereby securing the banner to the first and second extending arms.

In accordance with another object of the present invention there is provided a banner support assembly adapted to be mounted on an upstanding post for purposes of engaging and holding taut an elongated banner, said banner support assembly comprising: a) first and second horizontally extending arms mounted in spaced relation onto the upstanding post; b) first and second grooved housing members adapted to receive corresponding first and second reinforced banner extremities which are secured therein; c) multiple rod members secured to first and second housing members, connected with the banner extremities, and positioned through apertures in the first and second horizontally extending arms mounted onto the upstanding post; d) spring-loaded attachment means correspondingly working in combination with the rod members thereby securing the banner to the first and second horizontally extending arms.

Further objects and advantages of the present invention will be apparent from the following description, wherein preferred embodiments of the invention are clearly shown.

BRIEF DESCRIPTION OF THE INVENTION

The present invention will be further understood from the following description with reference to the drawings in which.

DETAILED DESCRIPTION OF THE INVENTION

Figure 1:
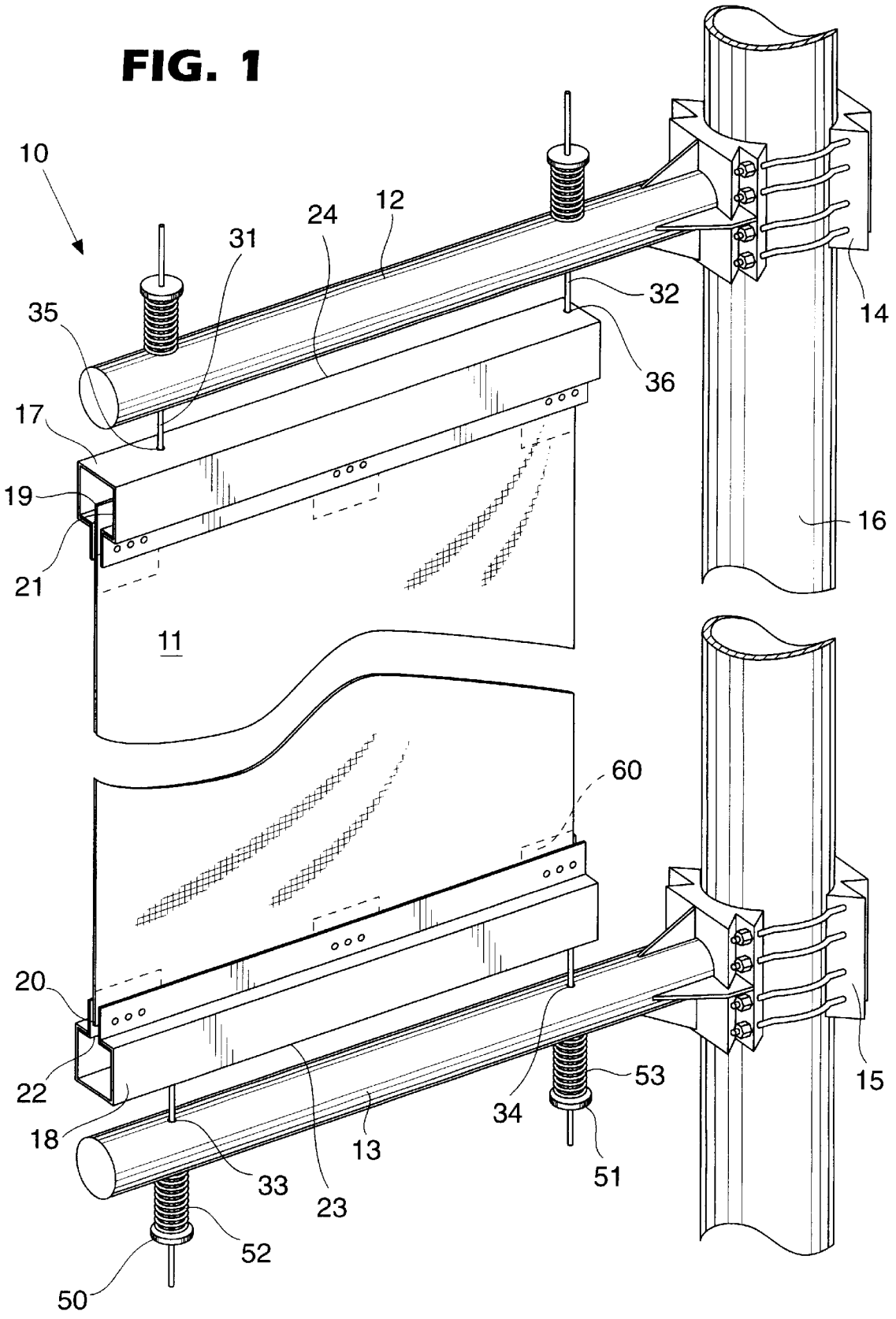
FIG. 1 is a perspective view of a banner support assembly embodying the invention.

Referring to FIG. 1, the new and improved banner support assembly is indicated generally by reference numeral 10.

The invention may be seen to comprise a banner 11 which is held taut between upper and lower extending arms 12 and 13 held in spaced relation by means of upper and lower bracket assemblies 14 and 15 which are fixed onto an upstanding post 16. It could also be seen that extending arms 12 and 13 could be attached to a flat planar surface such as a wall or even to a horizontally extending post with extending arms extending perpendicularly therefrom. More generally, the term supporting member can be used.

Figure 3:
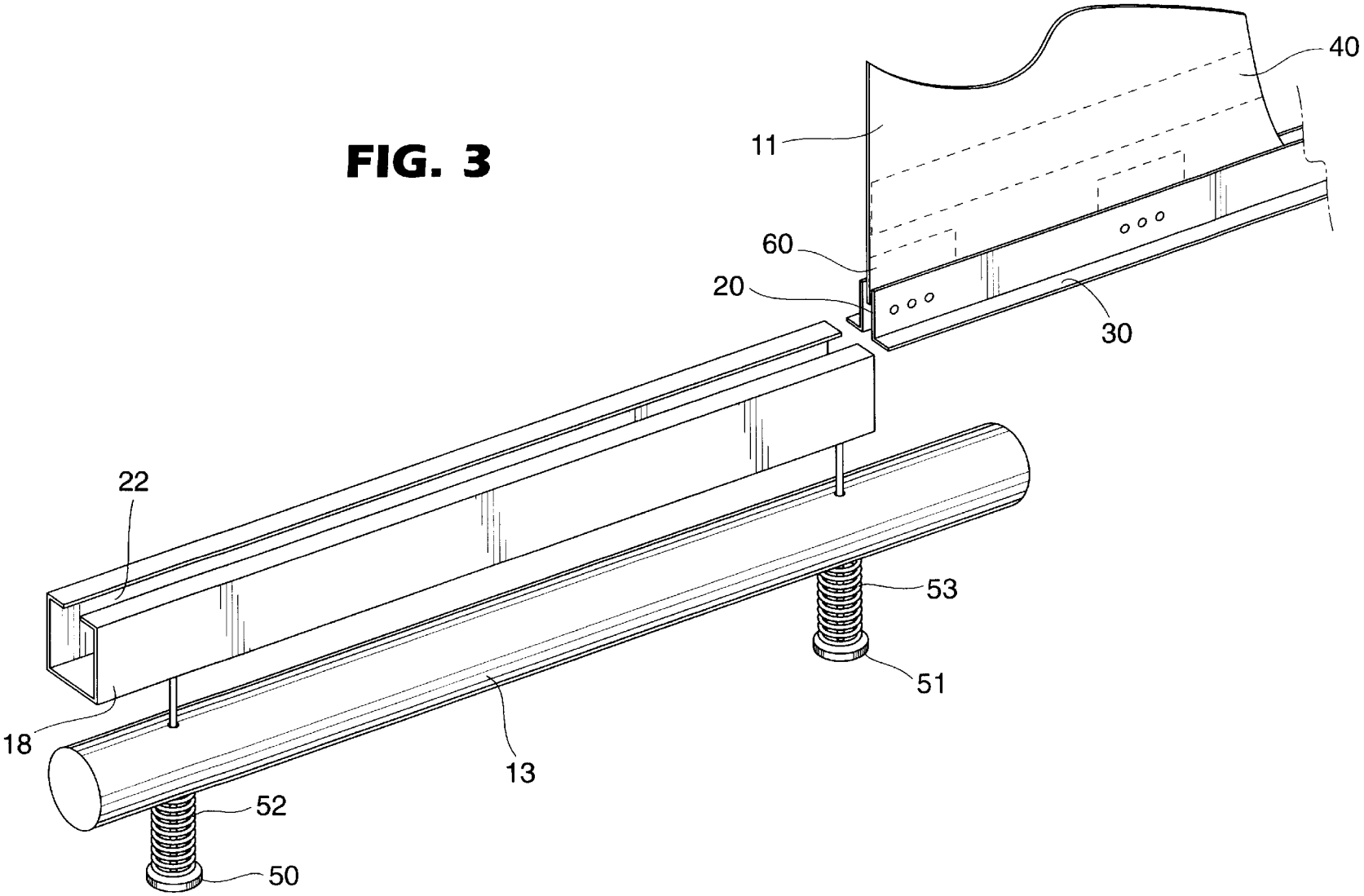
FIG. 3 is a perspective view of the banner support assembly prior to assembly.

The banner support assembly 10 includes upper and lower housing members 17 and 18 into which are adaptedly secured to the upper and lower extremities 19 and 20 of the banner 11. More specifically, the housing members 17 and 18 are unitary parts, preferably made of cast, non-rusting metal and includes groove-like openings 21 and 22 for allowing the banner's extremities 19 and 20 to be secured thereto. The banner's extremities 19 and 20 are slidably engaged into openings 21 and 22 and are securely held in place by attachment means and/or the use of angling plates 30, as seen in FIG. 3 (at both the upper and lower extremities) which are themselves securely fastened to the banner 11 per se. The angling plates 30 serve as reinforcing means in addition to the reinforcing means already forming part of the upper and lower extremities 19 and 20 of the banner. Banner reinforcing means can be of the type encompassing rigid plastic members 60 incorporated into the inner core of the banner. It should be noted that a sleeve and hem type of banner extremity could be used in combination thereof Once the banner 11 extremities 19 and 20 are securely attached to the housing members 17 and 18, a pair, but possibly more depending on the width of the banner 11 and the requirements of the situation, of rod members 31 and 32 are inserted through apertures 33 and 34 of the extending arms 12 and 13 and through to correspondingly aligned apertures 35 and 36 of the housing members 17 and 18 thereby linking the bottom part 23 of the lower housing member 18 and the top part 24, relatively speaking, of upper housing member 17 to their respective extending arms 13 and 12.

The manner of attaching the rod members 31 and 32 to the housing members 17 and 18 may vary and could encompass one of the following techniques, without being restrictive. Either the rod members 31 and 32 are enclosed and trapped in when manufacturing the housing members 17 and 18 or openings slightly larger than the rod members 31 and 32 diameter are machined as part of the housing members 17 and 18 and hook and grap means are provided to reciprocally achieve securement between the members 31 and 32 and the housing members 17 and 18.

Figure 2:
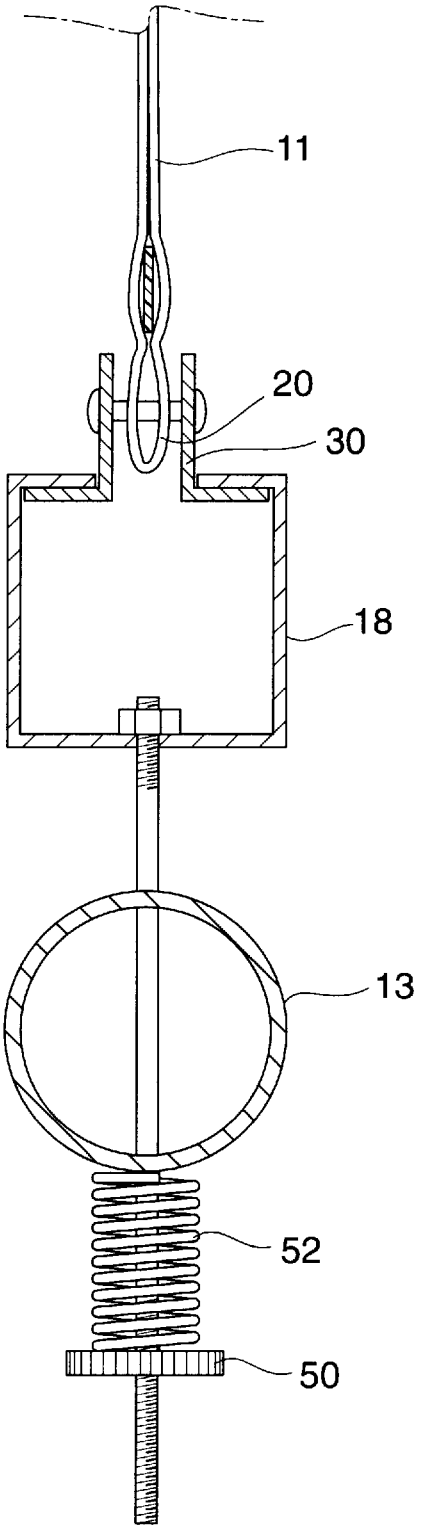
FIG. 2 is an end view on an enlarged scale of the lower assembled members.

Once the rod members 31 and 32 are securely attached to the housing members 17 and 18 and positioned through apertures 33 and 34 of the extending arms 12 and 13, one is left with securing the resulting banner structure to the extending arms 12 and 13. In order to achieve constant tensioning forces, flexibility and reliability two main options are possible. Either the use of a stop-lock member or with threaded rod members 31 and 32 it is possible to use a correspondingly threaded means. Referring to FIG. 2, there is illustrated threaded screw members 50 and 51 which when used in combination with spring-loaded members 52 and 53 allow for easy assembly and adjustability when faced with possibly slanting extending arms, of the banner structure and accrued flexibility in the face of weather elements as the spring members 52 and 53 will in effect absorb most forces exerted by the elements on the banner structure. Washers may also be installed between the spring members 52 and 53 and the extending arms 12 and 13 thereby providing for accrued support and releasing some of the pressure left being exerted on the extending arms 12 and 13 and the resulting banner structure. It should be noted that the spring-loaded members could be located elsewhere i.e. within the housing members or on the other side of the extending arms.

Figure 4:
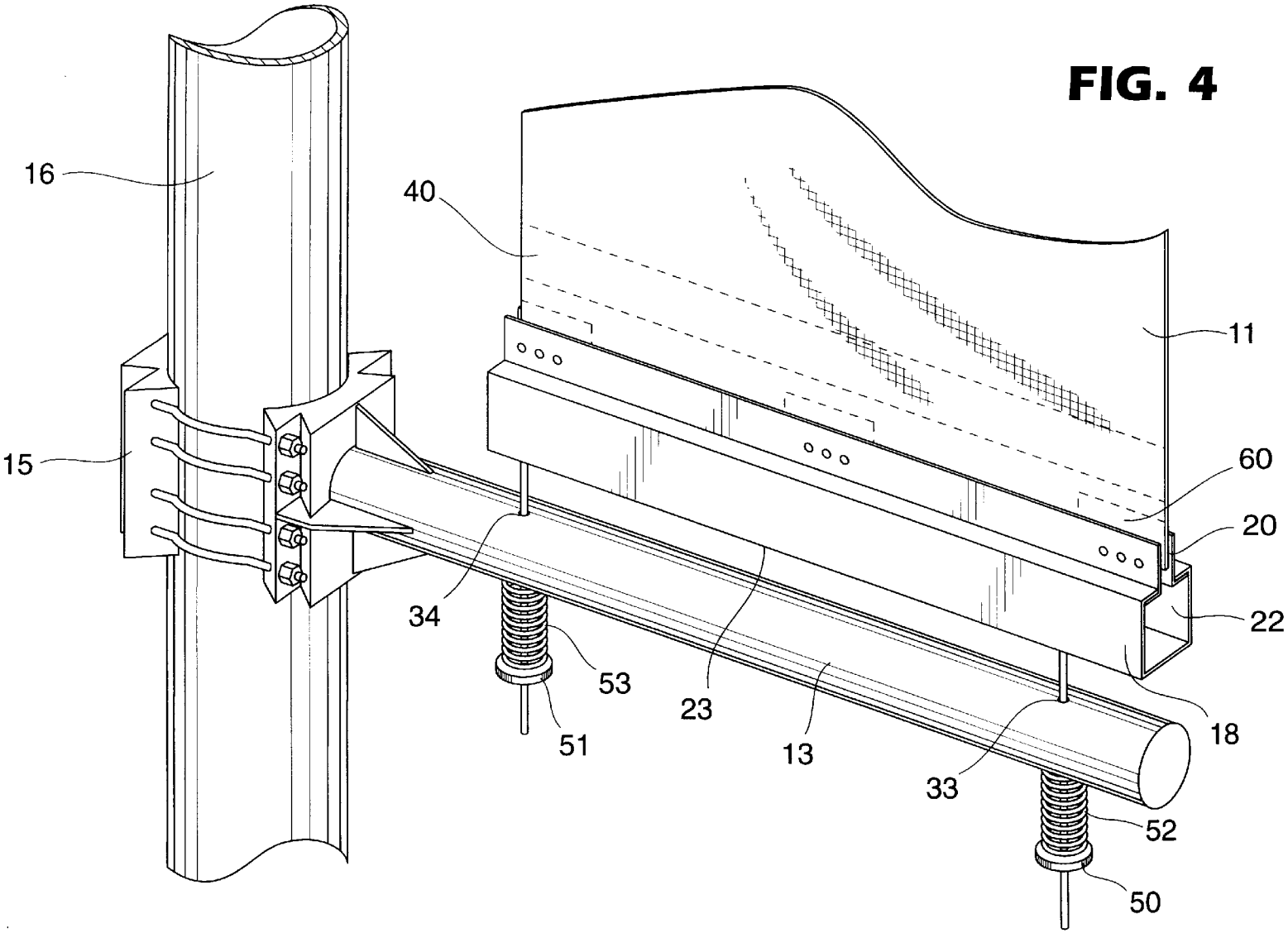
FIG. 4 is a perspective view of an alternate embodiment of the invention.

Referring to FIG. 4, in an alternate embodiment, there could be added an elastomeric member 40 to possibly one or both of the upper and lower sections of the banner 11 thereby increasing even more its flexibility and resiliency to weather elements.

Although a preferred embodiment has been described in the above paragraphs in sufficient detail so as to be readily understood by those skilled in the art, the following is a brief discussion of the operative characteristics of the invention in order to facilitate a further understanding thereof.

In practice, the upper and lower bracket assemblies 14 and 15 are first installed on the upstanding post 16 (or flat planar surface) using attachment means. The extending arms 12 and 13 are then secured to bracket assemblies 14 and 15 extending outwardly and at right angles to the upstanding post 16. It should also be noted that the bracket assembly and the extending arm may work as a single unit, as illustrated, without being restricted to this embodiment.

The reinforced banner extremities 19 and 20 are securely engaged and attached into openings 21 and 22 of the housing members 17 and 18. Rod members 31 and 32 are secured to the housing members 17 and 18 then positioned through apertures 33 and 34 of the extending arms 12 and 13.

It can be seen as easier with starting with the upper section of the banner 11 when fixedly positioning the banner 11 onto the extending arms 12 and 13. Once the upper section of the banner is securely positioned with attachment means onto upper extending arm 12, thanks to gravity the installer is then left with easy positioning of the rod members 31 and 32 into the lower extending arm 13 apertures 33 and 34 and adjusting to desired tautness through the use of members 50 and 51 in combination with spring members 52 and 53.

As has been described above, winds and/or banner expanding/retracting conditions will have a tendency to cause a banner to be torn from their support arms and shredded and destroyed, unless means for allowing the banner to move and bely to spill the wind from the banner are provided. The natural resilience of the banner construction of the invention used in combination with rod members and spring attachment means, producing a downward force on the upper extending arm and an upward force on the lower extending arm which forces are in great part transmitted to the spring attachment means and therefore absorbed by such, allows for efficient control of naturally generated forces and for the banner to appear taut at all times. A constant force is thereby applied to both the upper and the lower extending arms making it a proactive banner holding system rather than merely a reactive system.

The invention may be embodied in other specific forms without departing from the spirit or essential characteristics thereof. The present embodiments are therefore to be considered as illustrative and not restrictive, the scope of the invention being indicated by the appended claims rather than by the foregoing description, and all changes that come within the meaning and range of equivalency of the claims are therefore intended to be embraced therein.

The embodiment of the invention in which an exclusive property or privilege is claimed are defined as follows:

1. A banner support assembly configured to be mounted on a supporting member for purposes of engaging and holding taut an elongated banner, said banner support assembly comprising:

a. first and second extending arms each configured to be mounted in spaced relation onto the supporting member;

b. at least two housing members each having a pair of spaced apart angling plates configured to securely receive a corresponding one of first and second banner extremities therebetween, said first and second housing members having at least one aperture;

c. at least one rod member secured to said first and second housing members and positioned through said apertures in said first and second extending arms; and d. attachment means correspondingly working in combination with said at least one rod member thereby securing said first and second housing members to said first and second extending arms.

2. The banner support assembly according to claim 1, wherein said at least one rod member is threaded.

3. The banner support assembly according to claim 1, wherein said attachment means working in combination with said at least one rod member is springloaded.

4. The banner support assembly as recited in claim 1, wherein said attachment means is adjustable so that a biasing force exerted by said adjustable attachment means on said extending arms may be varied.

5. A combination of a elongated banner support assembly and banner mounted on a supporting member for purposes of engaging and holding taut said elongated banner by first and second banner extremities, comprising:

a. said elongated banner having said first and second extremities;

b. first and second horizontally extending arms mounted in spaced relation onto the supporting member, said first and second horizontally extending arms each having at least one aperture;

c. at least two grooved housing members each having a pair of spaced apart angling plates configured to receive said first and second banner extremities secured therebetween for holding taut said elongated banner;

d. multiple rod members secured to said at least two grooved housing members, and positioned through said at least one aperture in said first and second horizontally extending arms; and e. spring-loaded attachment means correspondingly working in combination with said rod members thereby securing said first and second grooved housing members to said first and second horizontally extending arms.

6. The combination according to claim 5, wherein the supporting member is an upstanding post.

7. The combination according to claim 5, wherein the supporting member is a planar surface.

8. The combination according to claim 5, wherein the supporting member is a horizontally extending post.

9. The combination according to claim 5, wherein the first and second banner extremities have reinforcing means.

10. The banner support assembly according to claim 9, wherein the reinforcing means is plastic.

11. The combination according to claim 5, wherein the banner is configured with at least one elastomeric member.

12. The combination of banner support assembly and banner as recited in claim 5, wherein said attachment means is adjustable so that a biasing force exerted by said adjustable attachment means on said extending arms may be varied.

13. A combination of a elongated banner support assembly and banner mounted on a supporting member for purposes of engaging and holding taut said elongated banner by first and second banner extremities, comprising:

a. said elongated banner having said first and second extremities each having at least one plastic reinforcement member;

b. first and second horizontally extending arms mounted in spaced relation onto the supporting member, said first and second horizontally extending arms each having at least one aperture;

c. at least two grooved housing members configured to receive said first and second banner extremities which are secured therein for holding taut said elongated banner;

d. multiple rod members secured to said at least two grooved housing members, and positioned through said at least one aperture in said first and second horizontally extending arms; and e. spring-loaded attachment means correspondingly working in combination with said rod members thereby securing said at least two grooved housing members to said first and second horizontally extending arms.

14. The combination of a banner support assembly and banner as recited in claim 13, wherein said attachment means is adjustable so that a biasing force exerted by said adjustable attachment means on said extending arms may be varied.

* * * * *